US007068168B2

(12) United States Patent
Girshovich et al.

(10) Patent No.: US 7,068,168 B2
(45) Date of Patent: Jun. 27, 2006

(54) WIRELESS ANTI-THEFT SYSTEM FOR COMPUTER AND OTHER ELECTRONIC AND ELECTRICAL EQUIPMENT

(76) Inventors: Simon Girshovich, Geula Str. 31/14, Kfar-Sava 44257 (IL); David Korman, Professor Dinor st. 8/2, Kfar-Sava 44245 (IL); Eli Blanka, Yalin st. 7, Petach Tikva (IL)

( * ) Notice: Subject to any disclaimer, the term of this patent is extended or adjusted under 35 U.S.C. 154(b) by 0 days.

(21) Appl. No.: 10/987,924

(22) Filed: Nov. 12, 2004

(65) Prior Publication Data

US 2006/0114110 A1 Jun. 1, 2006

(51) Int. Cl.
*G08B 13/14* (2006.01)

(52) U.S. Cl. ..... 340/568.3; 340/539.1; 340/572.1

(58) Field of Classification Search ..... 340/568.3, 340/568.2, 571, 572.1, 687, 539.1
See application file for complete search history.

(56) References Cited

U.S. PATENT DOCUMENTS 3,484,775 A * 12/1969 Cline ..... 340/568.3
4,121,201 A * 10/1978 Weathers ..... 340/568.3
4,945,341 A * 7/1990 Buttimer ..... 340/568.3
5,406,261 A * 4/1995 Glenn ..... 340/568.1
5,589,820 A 12/1996 Robinson
5,760,690 A 6/1998 French
5,947,256 A 9/1999 Patterson
5,963,131 A * 10/1999 D'Angelo et al. ..... 340/568.1
6,137,409 A 10/2000 Stephens
6,300,874 B1 10/2001 Rand
6,356,197 B1 3/2002 Patterson
6,507,914 B1 1/2003 Cain
6,628,198 B1 * 9/2003 Fieschi et al. ..... 340/568.3
6,690,279 B1 2/2004 Ruhrig
6,836,214 B1 * 12/2004 Choi ..... 340/568.3

FOREIGN PATENT DOCUMENTS

GB 2316211 A * 2/1998

* cited by examiner

*Primary Examiner*—Thomas Mullen
(74) *Attorney, Agent, or Firm*—Lilling & Lilling PLLC; Bruce E. Lilling; Sean Liam Kelleher

(57) ABSTRACT

The present invention is an anti-theft system for the surveillance of computers and high-risk electrical and electronic equipment. This system is based on activating an internal transmitter contained in the stolen equipment. In the case of stationary equipment the activation of the transmitter is carried out by the external power supply being disconnected. In the case of mobile equipment, the transmitter/transceiver is activated by an external power supply disconnection, in addition to a software command with password or remote control. The transmitter then emits encoded signals that are received by a receiver and causes the activation of an alarm system located at the checkpoint.

30 Claims, 5 Drawing Sheets

WIRELESS ANTI-THEFT SYSTEM FOR COMPUTER AND OTHER ELECTRONIC AND ELECTRICAL EQUIPMENT

FIELD OF THE INVENTION

The present invention relates to the surveillance of computers, electronic/electrical equipment and other valuable goods in order to reduce the possibilities of stealing them from a defined area through checkpoints. The equipment under surveillance could be hidden in any moving carrier, for example: people, cars, containers, etc and still be able to transmit signals.

DESCRIPTION OF THE PRIOR ART

Robinson (U.S. Pat. No. 5,589,820), Patterson (U.S. Pat. Nos. 5,947,256 and 6,356,197), and Ruhrig (U.S. Pat. No. 6,690,279) relate to the field of passive tags and are activated by an external electromagnetic/radio frequency (RF) field. These tags do not have an internal power supply and are active for short distances and in open spaces.

There are also active tags with internal batteries for different applications. Such tags provided by Avonwood Limited (UK) will constantly transmit a RF signal for the duration of batteries life. The other application is for payment of road tolls and the like, which is when the on-vehicle transmitter is activated by a roadside transmitter.

Rand (U.S. Pat. No. 6,300,874) and Stephens (U.S. Pat. No. 6,137,409) relate to the field of external accessories and are used exclusively in computers, like parallel port, Universal Serial Bus (USB) connector etc. There is a constant loop system that is always "on" and the alarm system is activated when the dongle or USB cable is disconnected.

Cain (U.S. Pat. No. 6,507,914) is in the field of radio frequency identification (RFID) and is related to a constant loop system that is always "on" and where the alarm system is activated by breaking the loop. The system is active for short distance and in open spaces.

French (U.S. Pat. No. 5,760,690) is in the field of electromechanical switches and is physically connected to the item being monitored. When the position of the switch is changed, it causes immediate alarm activation.

An integrated alarm system for portable computers has been developed which, when armed, sounds an alarm or disables the computer upon unauthorized movement of the computer from a stationary position. The alarm system includes one or more motion sensors and/or micro switches that provide a signal indicating that the portable computer has been moved from a stationary position or that the computer is being opened from its closed position.

There are some wireless anti theft devices on the market. G-B Electronics (Manufacturer and Distributor of Line-Sense). The system works in a constant loop. Each Line Sense transmits RF signals to a central station receiver. An incorporated sensor in the power cord detects a weak E-field. This field is present while the cord is plugged into a live outlet. During and after theft the device under surveillance is disconnected from the AC power and the system transmits an additional RF signal to the central base station receiver. This receiver is monitoring a limited and unshielded area that includes a number of wireless transmitters of equipment under surveillance. In order to increase the efficient area for monitoring, the power of the RF signal must be increased, which will cause people to be exposed to constant radiation and cause interference on other operating equipment.

There are active tags with internal batteries for different applications. Such tags provided by Avonwood Limited (UK) will constantly transmit a RF signal for the duration of the batteries' life. This equipment is related to the RFID technology, which was mentioned above.

In addition, there are active internal/external PC cards with internal batteries for different applications. Such cards provided by Checkpoint Sales & Marketing (UK), Wobbler Alarm (turn on by different types of key switch), function when a built-in alarm is activated when the equipment casing is tampered with. The card is switched on by key.

The other application is for collection of road tolls and fees, proposed by Thales e-Security (UK), when the on-vehicle transmitter is activated by a roadside transmitter. This equipment is related to the Dedicated Short Range Communication (DSRC) technology.

The existing solutions, mentioned above, are related to passive tags based on the RFID technology and are usually used in stores. The readers (transceivers) are sending the activation signal and energy to the tag, and the tag has to answer with its unique identification to the reader. This makes it necessary for the tag to have a direct angle visibility at the checkpoint to be able to communicate with the reader. Those solutions are suitable only for small distances and open spaces. RFID technology requires large number of readers, because of short-range activity. Such systems are complicated and expensive.

Another group relates to active tags, which are effective for DSRC and are activated by the external RF powerful source with a direct angle visibility at the checkpoint between the stationary transceiver and the mobile tag. Those systems are continuously emitting a RF field, for example on pay roads, which is applicable in the area without service personnel, but there is high radiation and thus a health risk. The transceiver is placed on the front window of the car and is not effective in the case when the transceiver is placed inside the car as a part of the stolen equipment/valuable goods, because of the shielding. It can be overcome by increasing the power of the stationary transceiver, which increases the radiation and health risk. Those systems are complicated and expensive.

There is great need for an anti-theft system for surveillance of computers, electrical and electronic equipment or other valuable goods, which is activated only when the equipment is stolen and detected at the checkpoint by a passive receiver without health risk for the service personnel in the vicinity of the spot. The system has to be simple and not require any maintenance.

SUMMARY OF THE INVENTION

It is, therefore, an object of this invention to solve the problems listed above. The proposed system is a wireless solution for the problem of surveillance of equipment/valuable goods, and consists of a transmitter and a receiver. The transmitter is hidden into the equipment/valuable goods and has an autonomic power supply, and is activated only when the equipment/valuable goods is disconnected from the power supply or a combination between power off and software command/remote control for mobile equipment/valuable goods. This system establishes communication between the transmitter and the receiver and causes the alarm when the stolen equipment/valuable goods appear in a defined range near the checkpoints. Even when the equipment/valuable goods are placed in shielding envelope, such as cars, containers, etc., the system is sufficiently sensitive to sound an alarm. The receiver is passive and does not cause any health risk to the service personnel.

The present invention relates to an electronic anti-theft system for computers, stationary electrical and electronic equipment and other valuable goods, and comprises some means that activates a transmitter when the equipment is disconnected from the power supply. Power for the transmitter is supplied by its internal battery or by the backup battery of the equipment. Once the equipment is disconnected from its power supply, the transmitter emits encoded signals that are received by an antenna of a receiver when the equipment comes into the vicinity of the antenna and causes an activation of an alarming sound, light or computer message. The transmitted signals penetrate even through a shielded envelope, as when the equipment under surveillance is placed in a car, container etc.

In the case of mobile equipment, as in a laptop, when the equipment is stationary, the activation of the transmitter is done in the same way as for stationary equipment as described above. In this case, when the equipment is functioning in the mobile mode, with an autonomic power supply, the activation or deactivation of the transmitter is done by the software control in addition to the disconnection from the equipment power supply. Power for the transmitter is supplied by its internal battery or by backup battery of the mobile equipment.

Each transmitter has an intrinsic code, which allows the receiver to determine the specific equipment being monitored. The internal anti-theft device has two options: (1) a transmitter only; or (2) a transceiver—includes a transmitter and a receiver—and the whole unit can be activated by a wireless coded signal, software and the equipment power disconnection.

DETAILED DESCRIPTION OF THE INVENTION

Referring now in more detail to the drawings, in which like numerals refer to like parts throughout the several views, and some of them are external of the equipment, the invention may be better understood.

Figure 1:
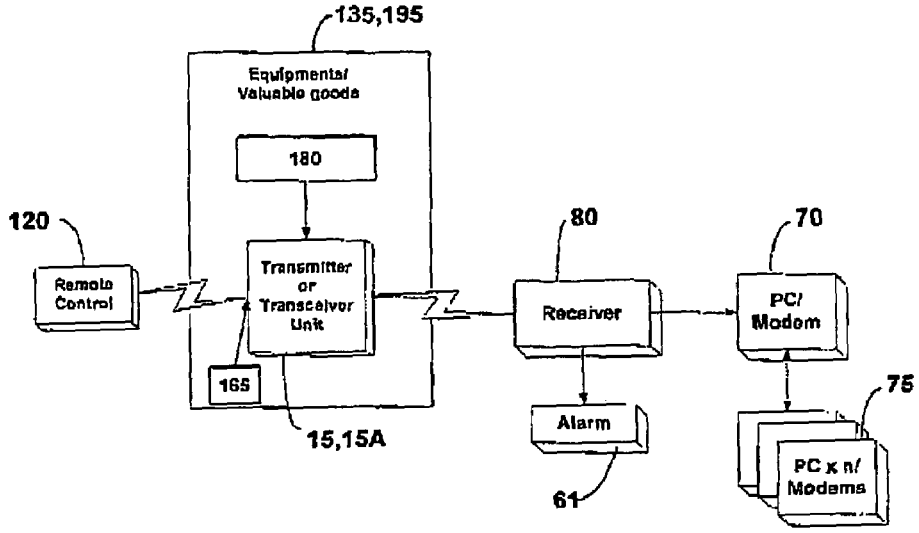
FIG. 1 is a block diagram of the system of this invention.

In short summary, as shown in FIG. 1 herein, the system herein first includes an activation means on input port 180, that activates the transceiver 15,15A. When the monitored or protected equipment 135, 195 is disconnected from the designated power supply, the activation means turns on a transmitter 15, 15A. Typically this activation means is concealed or hidden in the equipment. Power for the transmitter is supplied by its internal battery or by the backup battery of the equipment. Once the equipment is disconnected from its power supply, the transmitter emits encoded signals that are received by a receiver 80 when the equipment comes into the vicinity of the receiver. This causes an activation of an alarm 61, which may include a visual light, an audible sound or alarm, or a computer message. The transmitted signals are able to penetrate even through a shielded envelope, as when the equipment under surveillance is placed in a car, container etc., so as to be able to signal that the protected or monitored equipment has been moved beyond the designated area.

It should be appreciated that the instant invention may be used for protection and monitoring of any type of property and goods. While the herein description may refer generally to computers, stationary electrical and electronic equipment, and portable electronic equipment (like laptop computers), the herein system will work for any type of property, regardless of its value. Hereinafter, the term "equipment" will necessarily mean and include any type of goods or property that is to be protected, regardless of its value, and includes, but is not limited to, computers, stationary electrical and electronic equipment, and portable electronic equipment (like laptop computers).

Figure 2:
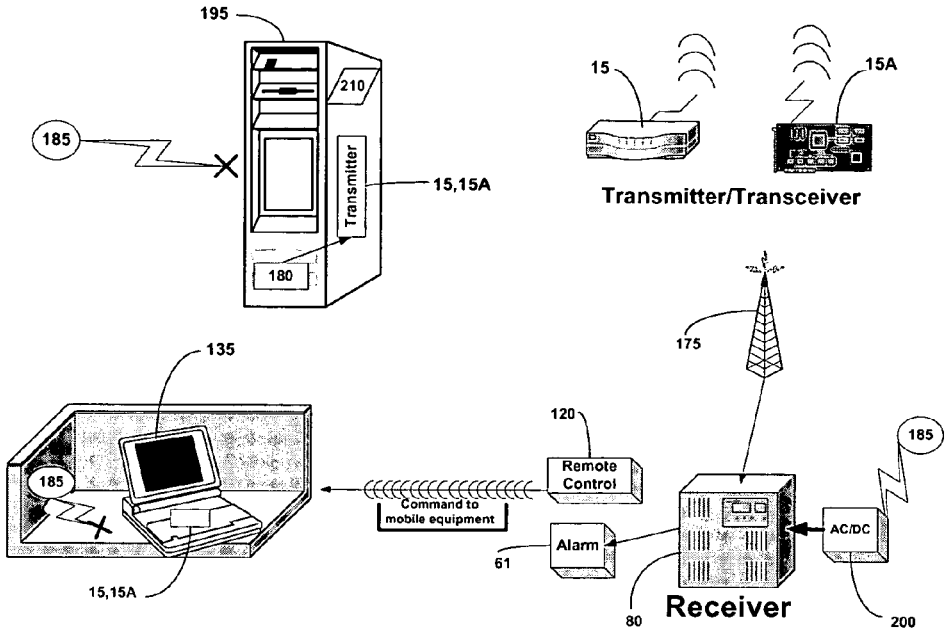
FIG. 2 is a block diagram, which shows the components of the system of this invention.

As shown in FIG. 2 herein, the system first includes a transmitter/transceiver 15, 15A, which is concealed or hidden into the equipment (as shown the equipment may be a laptop computer 135 or a hard drive 195). The transmitter/transceiver can be implemented in one of two manners, either as a stand-alone device 15 or as a PC card 15A, which is connected to the PCI/MINIPCI/CNR or other computer slot on the main electronic board in the computer. The transmitter/transceiver has a Central Processing Unit (CPU) 90 (see FIG. 3) with a plurality of input ports 100,101,165, 103,180 (see FIG. 4).

When the protected equipment (FIG. 2 shows both a desk top or stand alone computer 195 and a laptop computer 135) is disconnected from the power supply, input port 180 changes its voltage (from a value corresponding to a "1" logic to a value corresponding to a "0" logic) and CPU 90 of the transmitter 15,15A (see FIG. 4) accepts it and according to the software of the same CPU 90 activates the transmitter 15, 15A. This fulfills the function of an electronic switch to activate the transmitter at the appropriate time. Power for the transmitter may be supplied by its internal battery 105 (FIG. 4) or by the backup battery 115 (FIG. 4) of the protected equipment. It can be also an internal equipment battery 110 (FIG. 4), in the case of mobile equipment, such as a laptop computer 135.

Figure 5:
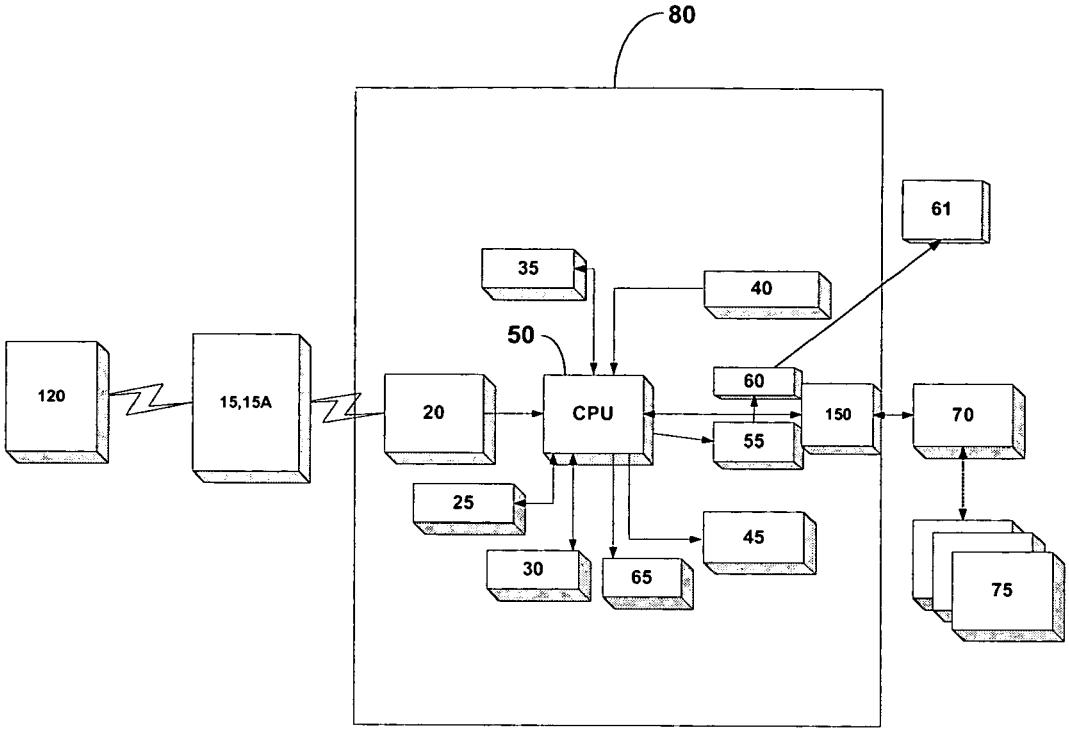
FIG. 5 is a block diagram of the receiver unit.

Once the protected equipment is disconnected from its power supply, the transmitter emits encoded signals that are obtained by the antenna 175 of the receiver 80 when the equipment comes into the vicinity of the receiver (see FIG. 2). This causes activation of an audible alarm 60, 61, visible alarm 65 (such as a light) or a computer message 45 (FIG. 5). The transmitted signals are able to penetrate even through a shielded envelope, as when the equipment under surveillance is placed in a car, container etc., to signal that the equipment has been moved beyond the allowed area.

For stationary equipment (like a desk top or stand alone computer 195), the internal electronic card of the equipment, like a Mother Board of a desk-top computer for example, the input port 180 (FIG. 4) of the CPU 90 obtains the onboard 5/3.3 DC voltage from the AC power by means of a cable from the wall connector 185 through the internal switching/linear DC power supply 210. This voltage, referred to as 'DV', is present onboard also when the equipment is switched off by the equipment's own on/off switch. Only when the AC power supply cable is physically disconnected from the equipment (i.e. taken without authorization or permission—stolen) will the 'DV' voltage not be present on the internal board anymore. At this point the 'DV' voltage is monitored by an input port 180 (FIG. 4) of the transmitter/transceiver by the CPU 90; and, when its voltage changes from a value corresponding to a "1" logic to a value corresponding to a "0" logic, the CPU activates the wireless transmitter unit 95 (see FIG. 4) of the transmitter/transceiver.

Figure 3:
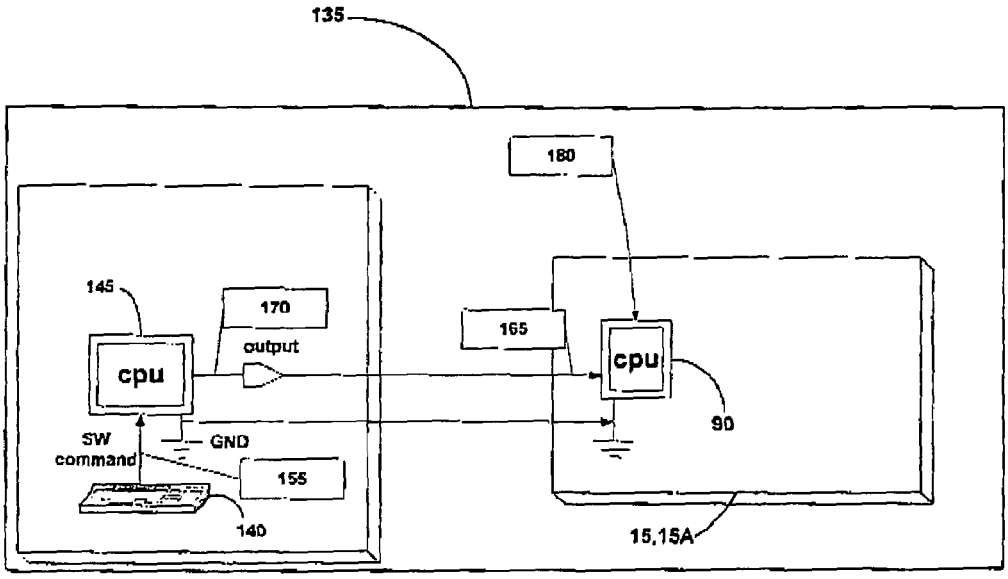
FIG. 3 is a block diagram of the mobile equipment and integrated transmitter/transceiver unit.

In the case of mobile equipment, like a laptop computer 135, there is the addition of a software ('SW') command 155 (see FIG. 3). This SW command with a special permitting password comes from the keyboard 140 of the mobile equipment 135 to the CPU 145 of the equipment by the driver, and sets the output port 170 of the equipment CPU 145. This command could be mapped as I/O or as memory. The output port 170 of the equipment CPU is connected to the input port 165 of the CPU 90 of the transmitter/transceiver. The combination of input ports 180 and 165 function like an electronic switch of the CPU 90 and allows the user to disconnect the mobile equipment, such as a laptop, from an external power supply without activating the transmitter/transceiver and vice versa. This fulfills the function of an electronic switch to activate the transmitter 15, 15A at the appropriate time.

Figure 4:
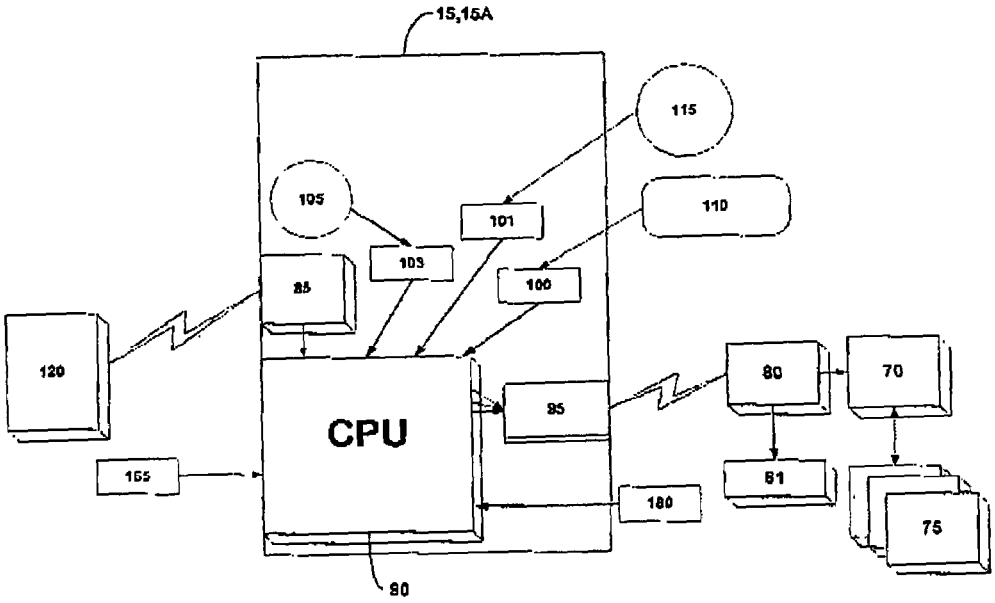
FIG. 4 is a block diagram of the transmitter/transceiver unit.

Another option for activating the transceiver 15, 15A of mobile equipment 135 is a software command for disconnection of the equipment power supply and is effected by a wireless command by an RF signal from a remote control unit 120 (FIG. 4). This broadcast is received by the receiver 85 (FIG. 4) of the transceiver 15, 15A, and combines with software to activate/deactivate the transmitter part of the transceiver 15, 15A, which is dedicated only for a specific remote control unit 120. The range could be a few meters, as desired, and be decoded by certain code per mobile equipment.

Referring to FIG. 4, the transmitter/transceiver ('TX') unit 15 is shown as being integrated as a part of the equipment (inside the equipment) and has its own power supply 105, preferably a 3v battery. This battery can be rechargeable, which allows the user to reuse the TX, and makes the useful life of the TX independent of the lifetime of the battery. Alternatively, the TX has an option to get power from an external power supply, such as backup battery 115 of the computer/equipment or a mobile equipment battery 110, such as for a laptop for example. Those options are controlled by the CPU 90 of the TX. Each battery 105,110,115 has its own input port 103, 100,101 of the TX CPU 90, so the CPU can monitor these ports and choose the appropriate power supply according to the SW of the CPU. SW sets the threshold for the critical voltage of batteries, so the CPU could give a warning to the user about low power battery.

The RF frequency range is 400–500 MHz, with FM modulation, which could also be ASK, FSK, BPSK, PSK, QPSK, OPSK, QAM or other. This frequency allows high penetration and wide range of the broadcast. The RF broadcast is periodic in the range between 1 ms to 10 seconds. The pulse width of the broadcast could vary from 5 microseconds up to 0.5 seconds, depending on the data and a modulation, which must be transferred to the receiver. To increase the reliability of data transfer of the system, an error correction algorithm may be included. Each TX module/unit has its own unique code, so detection of the equipment can be more precise and specific to certain equipment. By this means of broadcasting signals, the radiation is very low and the power consumption from the battery is very low too.

Before the equipment is intentionally disconnected, for example for repair or interruption of the external power supply, the TX is deactivated, so that false alarms are not generated. When the equipment is returned to the external power supply, the transmitter is reactivated and ready for any following disconnection/activation.

Referring to FIG. 2, the receiver 80 (RX) is shown as an external independent unit. The power supply 200 for this unit is external and could be provided by the 12v DC adapter from 220/110 AC voltage or a 12v DC cable from the car (could be an adaptor cable from the cigarette lighter or AC/DC adapter port).

Referring to FIG. 5, included within the RX 80 is a wireless receiver module 20, which gets the decoded RF signals and provides the appropriate signal, which interrupts the input of the RX CPU 50. This Interruption causes the internal CPU SW to activate the alarm system 55, 60 or visible warning sign, such as a light/LED 65 or display 45, which are integrated as part of the RX, or an external alarm 61, which may also be visible, light, audible, sound, computer command or any other warnings.

The RX has also the ability to store the configuration on I2C/ROM module 25, which could be configured dynamically by the external computer or by an internal keyboard 40 or fixed during the production of the RX module in the ROM. All events and parameters during the operation are stored in RAM 30, for processing by the CPU 50. Other data, parameters, like time, date, etc., are stored and backed-up by internal/external battery in the NVRAM 35 and gathered periodically to the external computer PC 70 through an interface of RS232 or USB (150) controlled by CPU 50. All data could be transferred to other computers/modems 75 via the telephone line/internet through a network/modem/internet/wireless access point, to security office, for example.

The RX could be located near the exit door of an office/company, before the main check point, and connected to the telephone line/internet through the modem or WLAN access point etc. to the central security office or connected to main alarm system, which could get the internal 60 or external 61 alarm from the RX when the equipment is carried out of the office without permission with the activated TX. Therefore, it is even possible that the stolen equipment may not even come into the vicinity of the central checkpoint. It is used like an intermediate checkpoint.

The invention is described in detail with reference to a particular embodiment, but it should be understood that various other modifications can be effected and still be within the spirit and scope of the invention.

We claim:

1. An anti-theft system for monitoring equipment, comprising:

a. activation means associated with a power supply of said equipment and generating an output when said power supply is disconnected from said equipment;

b. a transmitter connected to said output of said activation means and generating RF signals when said power supply is disconnected from said equipment;

c. means for deactivating said transmitter for an intentional disconnection of said equipment from said power supply and for reactivating of said transmitter when said power supply is reconnected to said equipment;

d. a receiver that receives the RF signals from the transmitter; and e. an alarm means activated when said receiver receives said RF signals from said transmitter.

2. An anti-theft system according to claim 1, wherein a frequency range of the RF signals from the transmitter are in the range of 400–500 MHz.

3. An anti-theft system according to claim 2, wherein the RF signals are modulated.

4. An anti-theft system according to claim 2, wherein the RF signals have a period in the range between 1 ms to 10 seconds.

5. An anti-theft system according to claim 4, wherein the pulse width of the RF signals is in the range of 5 microseconds up to 0.5 seconds.

6. An anti-theft system according to claim 2, wherein the pulse width of the RF signals is in the range of 5 microseconds up to 0.5 seconds.

7. An anti-theft system according to claim 1, wherein the RF signals have a period in the range between 1 ms to 10 seconds.

8. An anti-theft system according to claim 7, wherein the pulse width of the RF signals is in the range of 5 microseconds up to 0.5 seconds.

9. An anti-theft system according to claim 1, wherein the pulse width of the RF signals is in the range of 5 microseconds up to 0.5 seconds.

10. An anti-theft system according to claim 1, wherein the alarm means may generate a visible signal, an audible signal and/or a computer screen message.

11. An anti-theft system according to claim 1, wherein the transmitter is a stand-alone transceiver.

12. An anti-theft system according to claim 1, wherein the transmitter is a PC card installed in the equipment.

13. An anti-theft system according to claim 1, wherein the RF signals can penetrate a shield placed around the equipment.

14. An anti-theft system according to claim 1, wherein said means for deactivating comprising a remote command generated from a remote control unit associated with an RF signal to permit said power supply to be disconnected from said equipment without said activation means generating said output.

15. An anti-theft system according to claim 1, wherein said means for deactivating comprising a software command generated from the equipment to permit said power supply to be disconnected from said equipment without said activation means generating said output.

16. An anti-theft system according to claim 1, wherein the activation means includes a switch to activate the transmitter when the equipment is disconnected from the power supply.

17. An anti-theft system according to claim 1, wherein power for said transmitter is provided by a battery.

18. An anti-theft system according to claim 17, wherein said battery is internal to said transmitter.

19. An anti-theft system according to claim 17, wherein said battery is a component of said equipment.

20. An anti-theft system according to claim 1, wherein said RF signals include an error correction algorithm.

21. An anti-theft system according to claim 1, wherein said transmitter has a unique code.

22. A method of detecting unauthorized removal of equipment, comprising the steps of:

a. placement of a transmitter in communication with said equipment;

b. deactivating said transmitter for an intentional disconnection of the equipment from a power supply; and c. reactivation of said transmitter when said power supply is reconnected to said equipment;

d. providing a receiver at a designated location;

e. activation of said transmitter when said equipment is disconnected from a power supply;

f. generation of RF signals by said transmitter;

g. detection of said RF signals by said receiver; and h. generation of an alarm.

23. A method according to claim 22, wherein said transmitter consists of a PC card installed in said equipment.

24. A method according to claim 22, wherein a frequency range of the RF signals generated by said transmitter are in the range of 400–500 MHz.

25. A method according to claim 22, wherein the RF signals generated by said transmitter have a period in the range between 1 ms to 10 seconds.

26. A method according to claim 22, wherein the RF signals generated by said transmitter have a pulse width in the range of 5 microseconds up to 0.5 seconds.

27. A method according to claim 22, wherein the RF signals generated by said transmitter have an error correction algorithm.

28. A method according to claim 22, wherein the RF signals generated by said transmitter have a code unique to said transmitter.

29. A method according to claim 22, wherein said alarm is generated at said designated location, and wherein said designated location is pre-selected, based on where said alarm should be generated when said equipment is located at said location.

30. A method according to claim 22, further comprising providing receivers at designated locations, and wherein said alarm is generated at said designated locations, and wherein said designated locations are pre-selected, based on locations where said alarm should be generated when said equipment is located there.

* * * * *